US007564451B2

(12) United States Patent
Yang

(10) Patent No.: US 7,564,451 B2
(45) Date of Patent: Jul. 21, 2009

(54) ORGANIC LIGHT EMITTING DEVICE

(75) Inventor: Jin-Seok Yang, Chungcheongbuk-do (KR)

(73) Assignee: MagnaChip Semiconductor, Ltd., Chungcheonbuk-Do (KR)

( * ) Notice: Subject to any disclaimer, the term of this patent is extended or adjusted under 35 U.S.C. 154(b) by 767 days.

(21) Appl. No.: 11/193,161

(22) Filed: Jul. 29, 2005

(65) Prior Publication Data

US 2006/0022615 A1 Feb. 2, 2006

(30) Foreign Application Priority Data

Jul. 30, 2004 (KR) ..... 10-2004-0060554

(51) Int. Cl.
*G09G 5/00* (2006.01)

(52) U.S. Cl. ..... 345/204; 345/76; 345/77; 345/205

(58) Field of Classification Search ..... 345/76, 345/77, 204–205
See application file for complete search history.

(56) References Cited

U.S. PATENT DOCUMENTS 6,191,534 B1 2/2001 Schuler et al.
6,661,180 B2 12/2003 Koyama
6,710,548 B2 3/2004 Kimura
6,753,654 B2 6/2004 Koyama
2002/0196212 A1* 12/2002 Nishitoba et al. ..... 345/76
2007/0146249 A1* 6/2007 Kimura ..... 345/76

FOREIGN PATENT DOCUMENTS

JP 2002-333862 11/2002
JP 2004-29803 1/2004

* cited by examiner

*Primary Examiner*—Richard Hjerpe
*Assistant Examiner*—Leonid Shapiro
(74) *Attorney, Agent, or Firm*—Blakely, Sokoloff, Taylor & Zafman LLP

(57) ABSTRACT

An organic light emitting device driver for driving an organic light emitting device including a plurality of unit pixels each of which includes an organic light emitting element, the organic light emitting device driver includes: a discharge unit for generating a discharge current during a discharge period to thereby discharge a charge charged in the unit pixel, wherein the discharge unit includes: a switching unit for transferring a reference current in response to a predetermined voltage supplied to the unit pixel; and a current mirroring unit for outputting the discharge current generated by mirroring the reference current transferred by the switching unit.

7 Claims, 6 Drawing Sheets

ORGANIC LIGHT EMITTING DEVICE

FIELD OF INVENTION

The present invention relates to an organic light emitting device; and, more particularly, to a driver for an organic light emitting device.

DESCRIPTION OF PRIOR ART

Generally, a flat panel display (FPD) device is classified according to a material included in the FPD for emitting light. That is, an inorganic flat panel display device includes an inorganic material for emitting light and an organic flat panel display device includes an organic material for emitting light.

The inorganic flat panel display device includes a plasma display panel (PDP) using a photo luminescence (PL) of a fluorescent body and a field emission display (FED) using a cathode luminescence (CE). The organic flat panel display device includes a liquid crystal display (LCD) and an organic light emitting display panel.

Herein, the organic light emitting display panel has a response time which is as much as 30000 times faster than that of the LCD. Also, the organic light emitting display panel has an advantage of a wide viewing angle and a high brightness. Accordingly, the organic light emitting display panel is recently in the limelight as a next generation display panel.

FIG. 1 is a block diagram showing a display panel of a conventional organic light emitting device.

As shown, the display panel of the conventional organic light emitting device includes a plurality of unit pixels arranged in a matrix form and a driver unit. Herein, each of the plurality of unit pixels includes a single organic light emitting element.

A plurality of segment lines are arranged vertically and a plurality of common lines are arranged horizontally in the display panel of the conventional organic light emitting device. Herein, the segment line is also called a source line and the common line is also called a scan line.

The driver unit drives the plurality of unit pixels through the plurality of segment lines and the plurality of common lines.

FIG. 2 is a schematic circuit diagram showing the display panel of the conventional organic light emitting device shown in FIG. 1.

As shown, each of the plurality of unit pixels includes a single organic light emitting element and a single capacitor. Herein, one terminal of the single organic light emitting element and one terminal of the single capacitor are coupled to the segment line. The other terminal of the single organic light emitting element and the other terminal of the single capacitor are coupled to the common line.

FIG. 3 is a schematic circuit diagram showing a unit pixel 10 and the driver unit included in the display panel of the conventional organic light emitting device shown in FIG. 1.

As shown, the unit pixel 10 includes a capacitor Cp for supplying an organic light emitting element Dp and each terminals of the organic light emitting element Dp with a constant voltage.

The driver unit includes a precharge unit 20, a driving unit 30 and a discharge unit 40.

The precharge unit 20 supplies the organic light emitting element Dp with a precharge current Ip through a segment line during a precharge period. The driving unit 30 supplies the organic light emitting element Dp with a driving current Id through the segment line during a driving period. The discharge unit 40 receives a discharging current Idis from the unit pixel 10 through the segment line during a discharge period.

A common line coupled to the unit pixel 10 is connected to a first switch S4 for selectively connecting a power supply voltage VCC and a ground voltage VSS to the common line. The first switch S4 connects the common line to the power supply voltage VCC for disabling the organic light emitting element Dp included in the unit pixel 10 during the discharge period. On the contrary, the first switch S4 connects the common line to the ground voltage VSS during the precharge period, the driving period or a null period.

The precharge unit 20 includes a precharge current source 21 for supplying the precharge current Ip and a second switch S1 for connecting the precharge current source 21 to the segment line.

The driving unit 30 includes a driving current source 31 for supplying the driving current Id and a third switch S2 for connecting the driving current source 31 to the segment line.

The discharge unit 40 includes a zener diode Dz for flowing the discharge current Idis and a fourth switch S3 for connecting the zener diode Dz to the segment line.

Herein, the zener diode Dz is not integrated into a chip of the driver unit. That is, the zener diode Dz is located outside of the chip of the driver unit and is connected to the segment line through a pad 41.

FIG. 4 is a wave diagram showing operations of the driver unit shown in FIG. 3 according to operation periods. As shown, the operation periods include the null period, the precharge period, the driving period and the discharge period.

FIGS. 5A to 5D are equivalent circuit diagrams showing the driver unit shown in FIG. 3 according to the operation periods shown in FIG. 4. FIGS. 5A to 5D are equivalent circuit diagrams when the driver unit is operated in the null period, the precharge period, the driving period and the discharge period respectively.

The operations of the driver unit are described below referring to FIGS. 1 to 4 and FIGS. 5A to 5D.

Referring to FIG. 5A, the second to fourth switches S1 to S3 are turned off during the null period.

Referring to FIG. 5B, during the precharge period, the third and the fourth switches S2 and S3 are turned off and the second switch S1 is turned on in response to a common line selection signal.

Therefore, the precharge current Ip generated by the precharge current source 21 is supplied to the unit pixel 10. The precharge period is for adjusting both terminal voltages Va and Vb of the organic light emitting element Dp to a threshold voltage Vth before the driving period where the driving current Id is supplied to the unit pixel 10 for the organic light emitting element Dp to emit light.

A required voltage for operating the organic light emitting element Dp is very high. However, most of the required high voltage is consumed for the threshold voltage Vth and a voltage level for actually operating the organic light emitting element Dp is not so high. Therefore, during the precharge period, the terminal voltages Va and Vb of the organic light emitting element Dp are adjusted to the threshold voltage Vth before the driving period.

That is, since a predetermined current should be supplied to the organic light emitting element Dp for the organic light emitting element Dp to emit light and the organic light emitting element Dp includes the capacitor Cp, both terminal voltages Va and Vb of the organic light emitting element Dp are required to be higher than a predetermined voltage level, i.e., the threshold voltage Vth. The above-mentioned operation for adjusting both terminal voltages Va and Vb is performed during the precharge period. Then, during the driving period, an actual current for the organic light emitting element Dp to emit light is supplied.

Without the precharge period, a data driving current for showing data is also consumed for adjusting the terminal voltages Va and Vb to the threshold voltage Vth. Therefore, the organic light emitting element Dp may not normally show all sorts of scale.

Thereafter, referring to FIG. 5C, during the driving period, the second switch S1 and the fourth switch S3 are turned off and the third switch S2 is turned on. Therefore, the driving current Id generated by the driving current source 31 is supplied to the unit pixel 10. Then, the organic light emitting element Dp emits light according to the driving current Id.

Thereafter, referring to FIG. 5D, during the discharge period, the second switch S1 and the third switch S2 are turned off and the fourth switch S3 is turned on. Therefore, during the discharge period, a charged electrical charge in the unit pixel 10 is discharged through the ground voltage VSS. Herein, the discharge current Idis is supplied to the discharge unit 40.

After the discharge period, the null period, the precharge period, the driving period and the discharge period are repeated.

Meanwhile, the discharge unit 40 includes the zener diode Dz. Herein, unlike a general diode, a zener diode holds constant voltage level at both terminals when a voltage is reversely supplied. Accordingly, when the unit pixel 10 is discharged before the unit pixel is charged using the zener diode Dz, the terminal voltage Va holds a constant voltage level.

Generally, characteristics of a zener diode are determined during a manufacturing process. Therefore, since the driver unit of the conventional organic light emitting device performs the above-mentioned discharge operation by using the zener diode, the zener diode should be replaced with another zener diode having different characteristics for adjusting the terminal voltage Va at the discharge period.

In addition, in process of time, the zener diode cannot hold a reversed voltage due to a leakage current. Further, since the zener diode is located outside of the driver unit, the zener diode is an obstacle of integration of an organic light emitting device.

SUMMARY OF INVENTION

It is, therefore, an object of the present invention to provide a driver of an organic light emitting device for adjusting a voltage supplied to a unit pixel during a discharge period.

In accordance with an aspect of the present invention, there is provided an organic light emitting device driver for driving an organic light emitting device including a plurality of unit pixels each of which includes an organic light emitting element, the organic light emitting device driver including: a discharge unit for generating a discharge current during a discharge period to thereby discharge a charge charged in the unit pixel, wherein the discharge unit includes: a switching unit for transferring a reference current in response to a predetermined voltage supplied to the unit pixel; and a current mirroring unit for outputting the discharge current generated by mirroring the reference current transferred by the switching unit.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF INVENTION

Hereinafter, a driver of an organic light emitting device in accordance with the present invention will be described in detail referring to the accompanying drawings.

Figure 1:
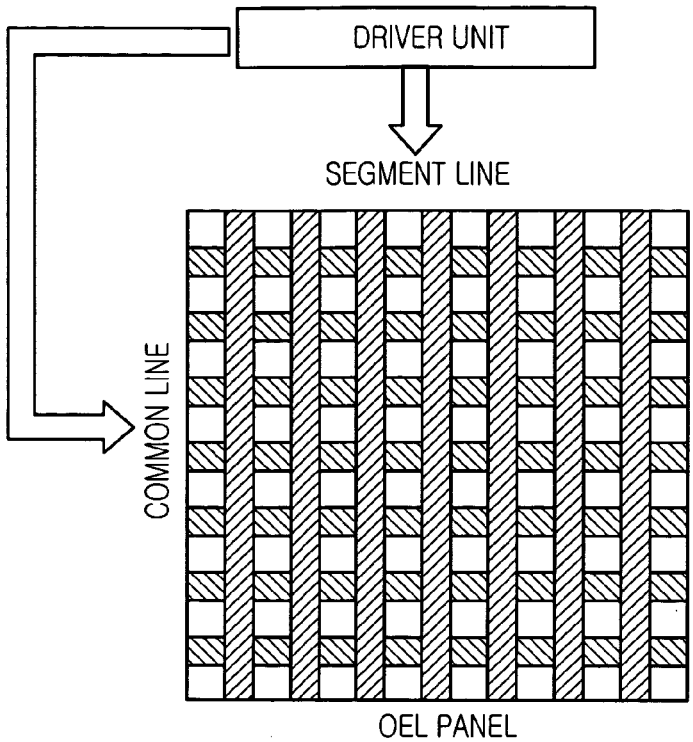
FIG. 1 (PRIOR ART)
FIG. 1 is a block diagram showing a display panel of a conventional organic light emitting device.
Figure 2:
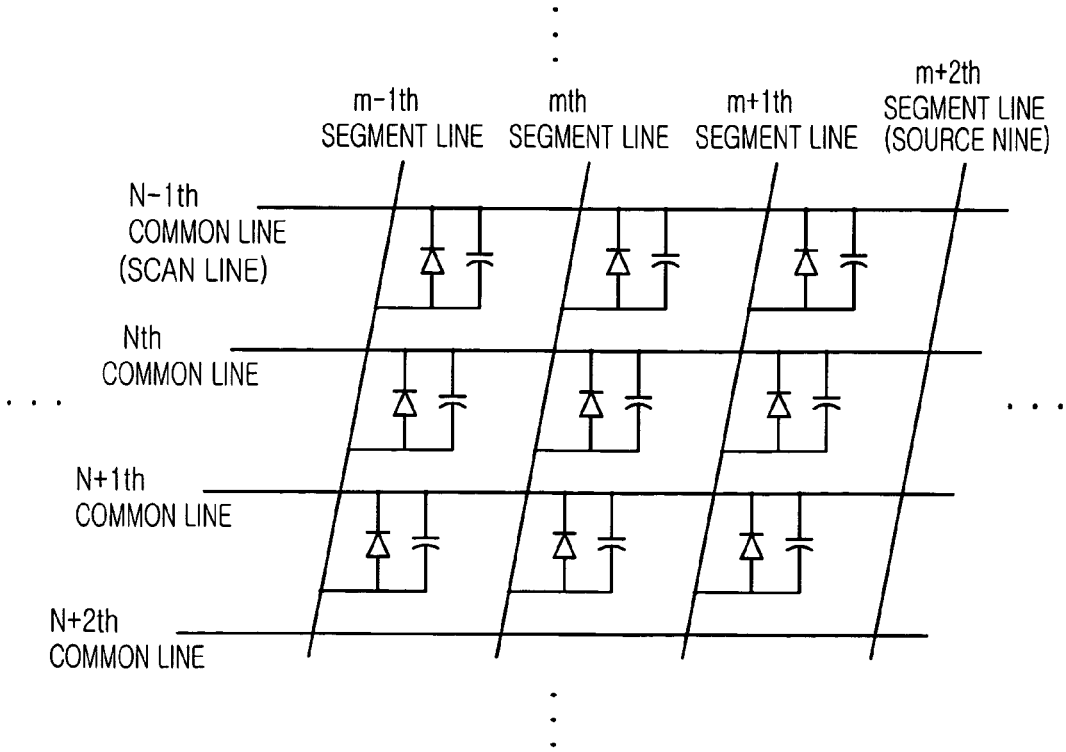
FIG. 2 (PRIOR ART)
FIG. 2 is a schematic circuit diagram showing the display panel of the conventional organic light emitting device shown in FIG. 1.
Figure 3:
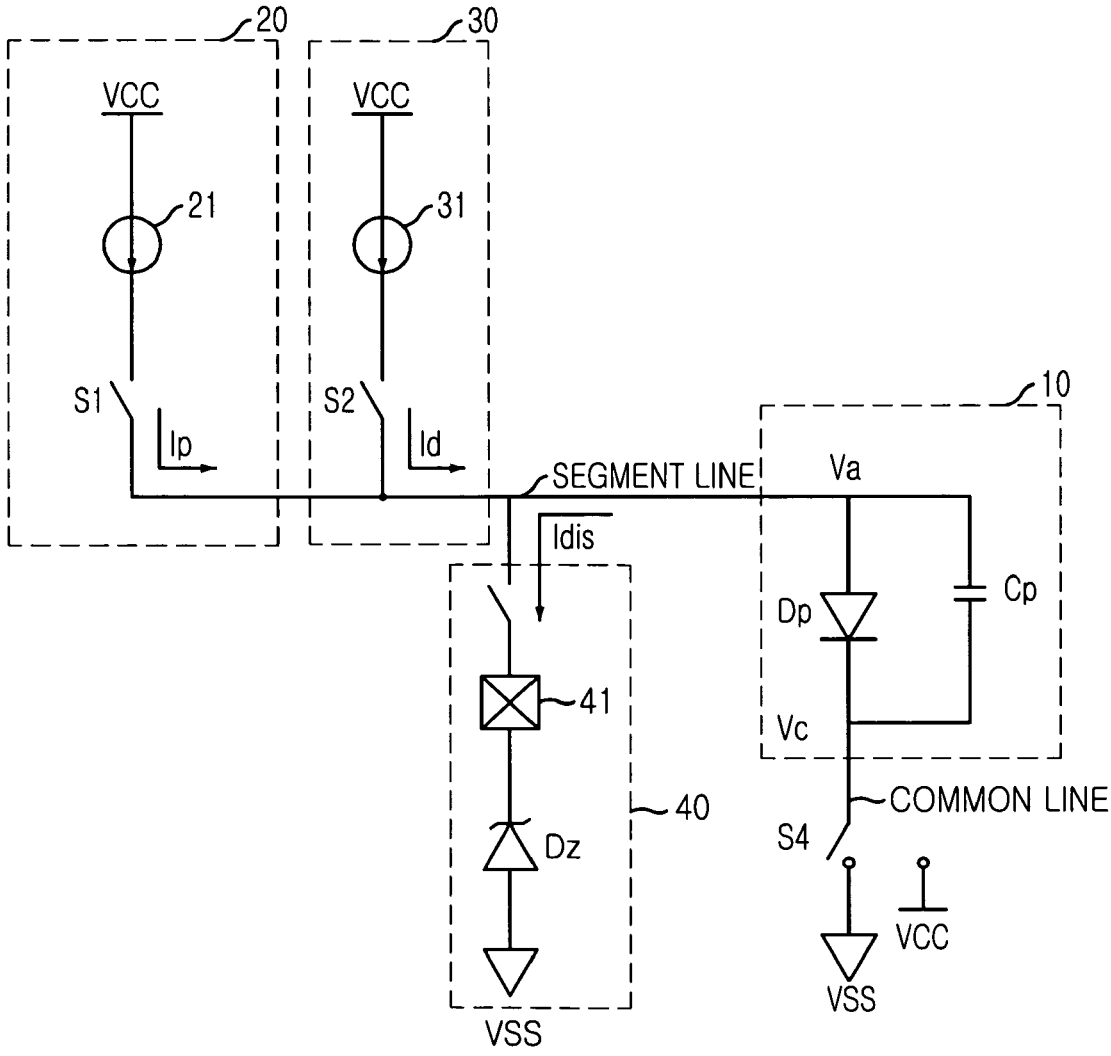
FIG. 3 (PRIOR ART)
FIG. 3 is a schematic circuit diagram showing a unit pixel and a driver unit included in the display panel of the conventional organic light emitting device shown in FIG. 1.
Figure 4:
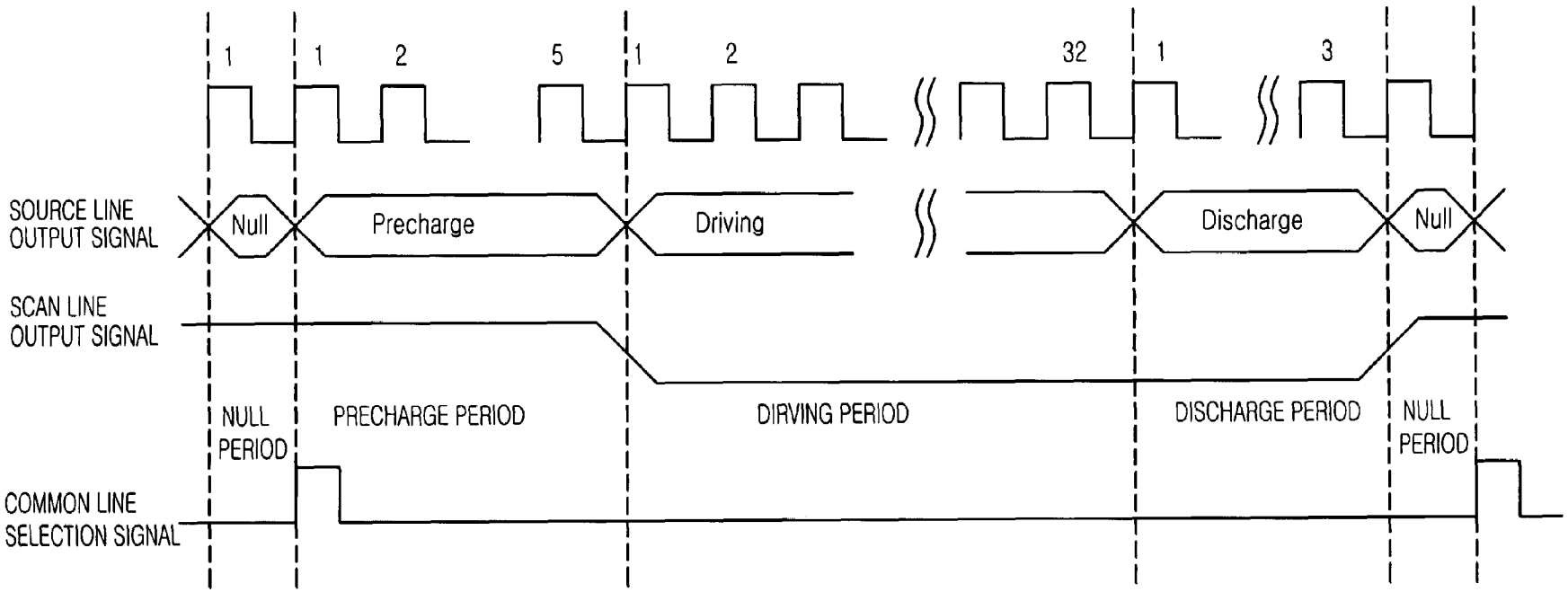
FIG. 4 (PRIOR ART)
FIG. 4 is a wave diagram showing operations of the driver unit shown in FIG. 3.
Figure 5A:
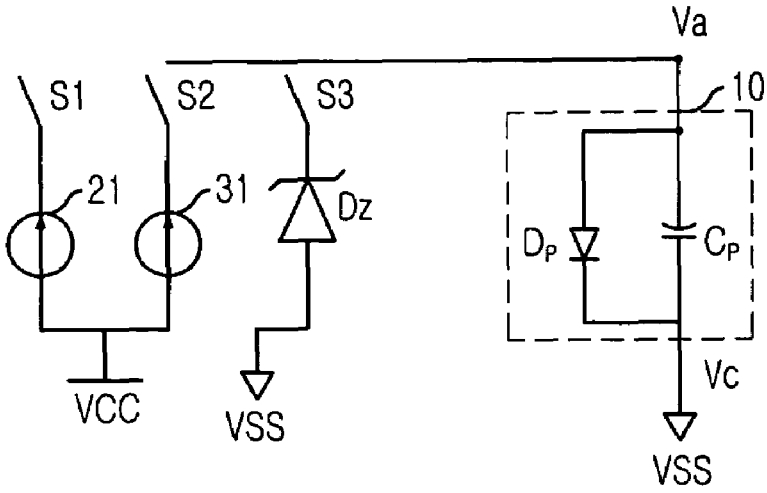
FIG. 5A (PRIOR ART)
FIGS. 5A to 5D are equivalent circuit diagrams showing the driver unit shown in FIG. 3 according to operation periods shown in FIG. 4.
Figure 5B:
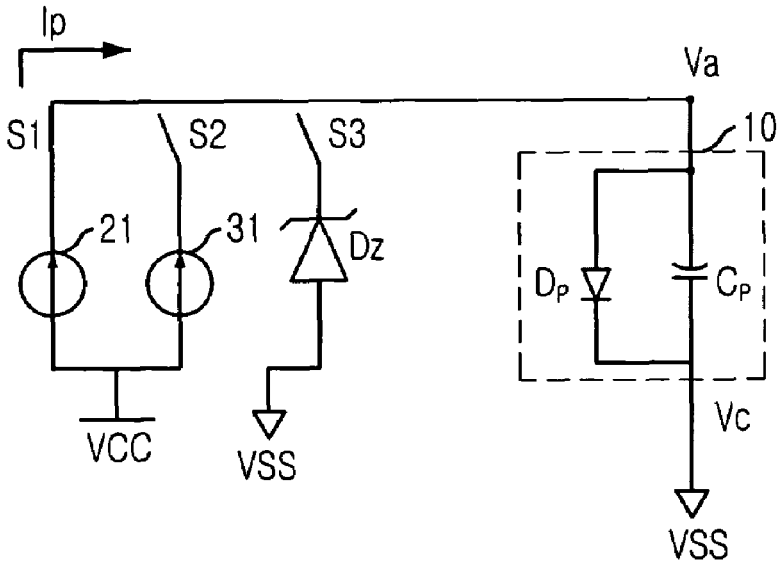
FIG. 5B (PRIOR ART)
Figure 5C:
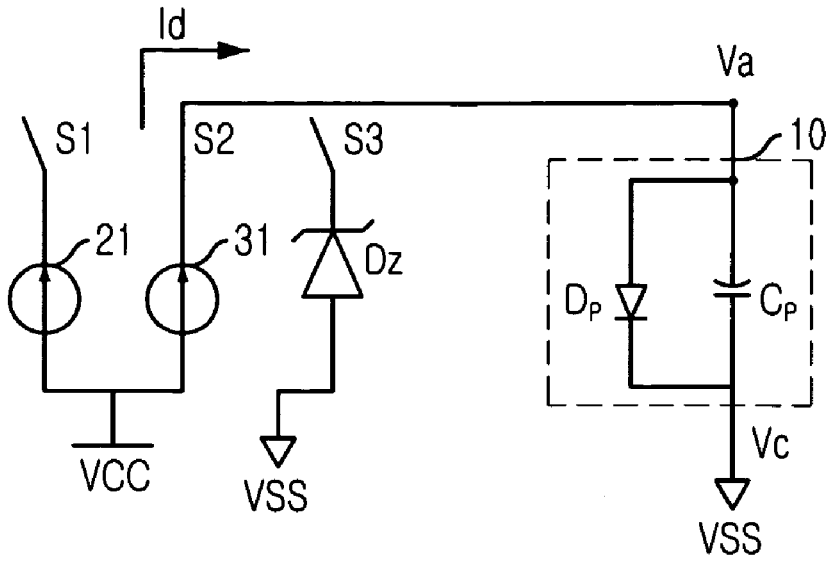
FIG. 5C (PRIOR ART)
Figure 5D:
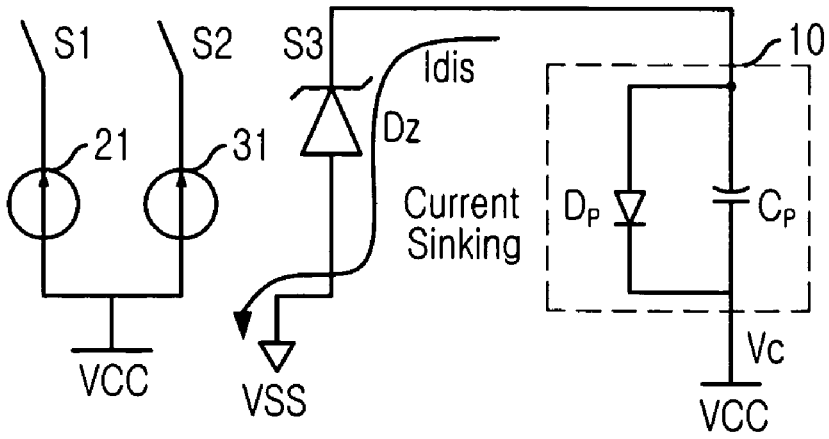
FIG. 5D (PRIOR ART)
Figure 6:
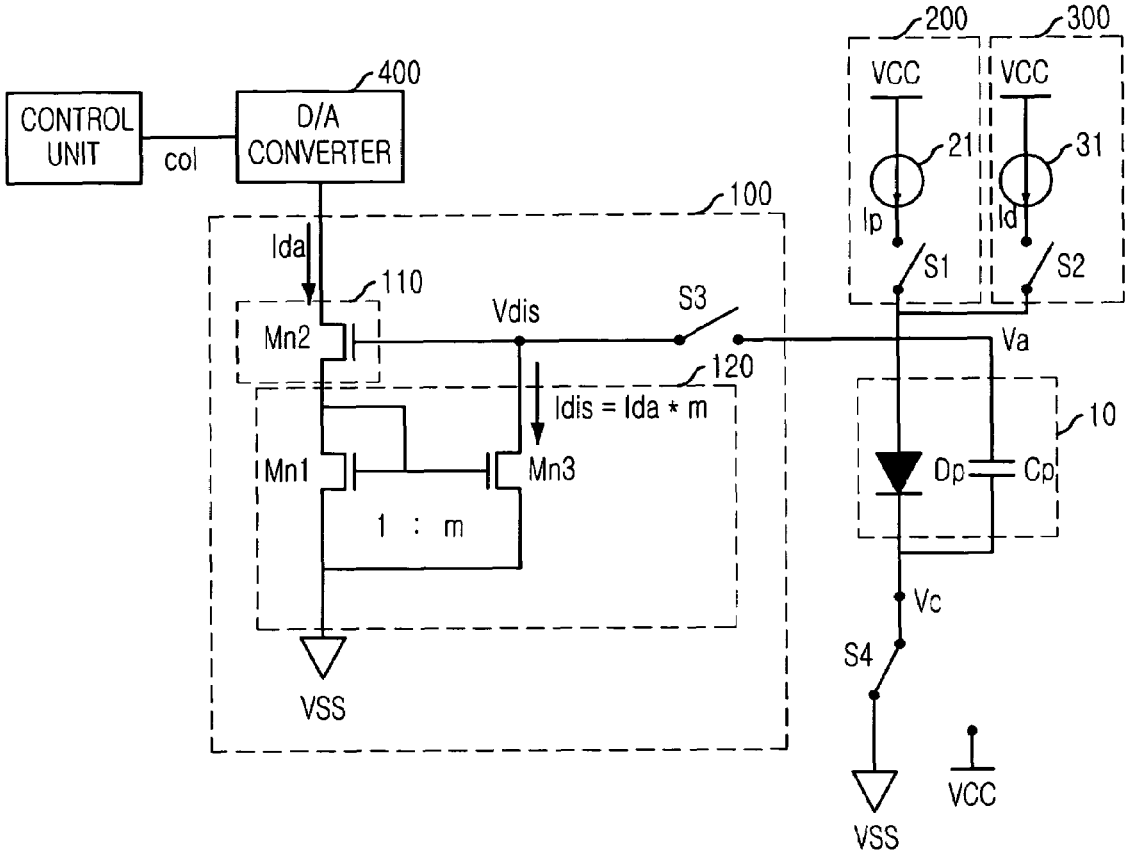
FIG. 6 is a schematic circuit diagram showing an organic light emitting device driver in accordance with a preferred embodiment of the present invention.

FIG. 6 is a schematic circuit diagram showing an organic light emitting device driver in accordance with a preferred embodiment of the present invention.

As shown, the organic light emitting device driver includes a unit pixel 10 having an organic light emitting element and a discharge unit 100 for generating a discharge current Idis to thereby discharge a charge in the unit pixel 10 during a discharge period.

The discharge unit 100 includes a switch unit 110 and a current mirror 120. The switch unit 110 transfers a reference current Ida in response to a discharge voltage Vdis supplied to the unit pixel 10. The current mirror 120 mirrors the reference current Ida to thereby generates the discharge current Idis (=Ida×m).

The switch unit 110 includes a first metal oxide semiconductor (MOS) transistor Mn2. The first MOS transistor Mn2 receives the discharge voltage Vdis through a gate of the first MOS transistor Mn2 to thereby transfer the reference current Ida to the current mirror 120.

The current mirror 120 includes a second MOS transistor Mn1 and a third MOS transistor Mn3.

The second MOS transistor Mn1 is diode-connected, i.e., one terminal and a gate of the second MOS transistor Mn1 are coupled each other to receive the reference current Ida. The other terminal of the second MOS transistor Mn1 is coupled to a ground voltage VSS.

The third MOS transistor Mn3 outputs the discharge current Idis generated by mirroring the reference current Ida to the ground voltage VSS. A gate and one terminal of the third MOS transistor Mn3 are respectively connected to the gate of the second MOS transistor Mn1 and the ground voltage VSS. The other terminal of the third MOS transistor Mn3 is selectively connected to the unit pixel 10.

Herein, the discharge unit 100 further includes a discharge switch S3 for connecting the discharge unit 100 to the unit pixel 10.

Meanwhile, the organic light emitting device driver further includes a digital-analog converter 400, a precharge unit 200 and a driving unit 300.

The digital-analog converter 400 generates the reference current Ida according to a digitized control signal Col.

The precharge unit 200 includes a precharge current source 21 for supplying a precharge current Ip to the unit pixel 10 during a precharge period and a precharge switch S1 for connecting the precharge current source 21 to the unit pixel 10.

The driving unit 300 includes a driving current source 31 for supplying a driving current Id to the unit pixel 10 during a driving period and a driving switch S2 for connecting the driving current source 31 to the unit pixel 10.

Referring to FIG. 6, operations of the organic light emitting device driver in accordance with the preferred embodiment of the present invention are descried below.

Operations at the precharge period and the driving period are same to those of the conventional organic light emitting device driver. That is, the precharge switch S1 is turned on to thereby supply the precharge current Ip generated by the precharge current source 21 to the unit pixel 10 during the precharge period. Then, during the driving period, the driving switch S2 is turned on to thereby supply the driving current Id generated by the driving current source 31 to the unit pixel 10. At this time, an organic light emitting element Dp included in the unit pixel 10 emits light in response to the driving current Id.

Thereafter, at the discharge period, the discharge switch S3 is turned on so that the discharge current Idis is outputted from the discharge unit 100. Herein, a switch S4 is coupled to the unit pixel 10. As above-mentioned, the switch S4 is connected to a power supply voltage VCC at the discharge period and is connected to the ground voltage VSS at the precharge period and the driving period.

Thereafter, at the discharge period, the digital-analog converter 400 generates the reference current Ida in response to the digitized control signal Col generated by a control unit.

When the discharge switch S3 is turned on at the discharge period, a node Va of the unit pixel 10 is coupled to the gate of the first MOS transistor Mn2 included in the discharge unit 100. Therefore, the second MOS transistor Mn2 is turned on so that the reference current Ida generated by the digital-analog converter 400 is transferred to the second MOS transistor Mn1.

Since the second MOS transistor Mn1 is diode-connected, the second MOS transistor Mn1 is turned on in response to the reference current Ida. The third MOS transistor Mn3 forming a current mirror with the second MOS transistor Mn1 is also turned on to thereby output the discharge current Idis generated by mirroring the reference current Ida to the ground voltage VSS.

The discharge current Idis is determined by a channel ratio between the second MOS transistor Mn1 and the third MOS transistor Mn3. In case that the channel ratio between the second MOS transistor Mn1 and the third MOS transistor Mn3 is 1:m, when the reference current Ida is flown on the second MOS transistor Mn1, a current flown on the third MOS transistor Mn3, i.e., the discharge current Idis, is Ida×m.

As the discharge current Idis flows, a voltage level of the node Va is decreased. When the voltage level of the node Va is lower than a threshold voltage Vth of the first MOS transistor Mn2, the first MOS transistor Mn2 is turned off. Accordingly, the current mirror 120 is disabled so that the voltage level of the node Va is not decreased.

Therefore, since the third MOS transistor Mn3 is turned off after the voltage level of the node Va becomes lower than a predetermined voltage level and there are no other current flows except for a leakage current of the third MOS transistor Mn3, the node Va can hold a constant voltage level.

Therefore, by controlling a channel size of the first MOS transistor Mn2, a gate-source voltage level of the first MOS transistor Mn2 according to the reference current Ida is controlled. As a result, the discharge voltage Vdis loaded on the node Va can be determined.

Accordingly, in accordance with the present invention, a voltage level supplied to a unit pixel during the discharge period can be controlled. Further, by not using a zener diode, a leakage current generated due to the zener diode can be prevented so that a discharge operation can be stably performed.

The present application contains subject matter related to Korean patent application No. 2004-60554, filed in the Korean Patent Office on Jul. 30, 2004, the entire contents of which being incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. An organic light emitting device driver for driving an organic light emitting device including a plurality of unit pixels each of which includes an organic light emitting element, the organic light emitting device driver comprising:

a discharge unit for generating a discharge current during a discharge period to thereby discharge a charge charged in the unit pixel, wherein the discharge unit includes:

a switching unit for transferring a reference current in response to a predetermined voltage supplied to the unit pixel; and a current mirroring unit for outputting the discharge current generated by mirroring the reference current transferred by the switching unit, wherein the current mirroring unit includes:

a first MOS transistor which is diode connected, a gate and one terminal of the first MOS transistor receiving the reference current and the other terminal of the first MOS transistor being coupled to a ground voltage; and a second MOS transistor for outputting the discharge current to the ground voltage, wherein a gate and one terminal of the second MOS transistor are respectively coupled to the gate of the first MOS transistor and the unit pixel and the other terminal of the second MOS transistor is coupled to the ground voltage.

2. The organic light emitting device driver as recited in claim 1, further comprising a digital-analog converter for generating the reference current according to a digitized control signal.

3. The organic light emitting device driver as recited in claim 1, wherein the switching unit is a metal oxide semiconductor (MOS), a gate of the switching unit receiving the predetermined voltage for transferring the reference current to the current mirroring unit.

4. The organic light emitting device driver as recited in claim 1, wherein the discharge unit includes a discharge switch for connecting the discharge unit to the unit pixel during the discharge period.

5. The organic light emitting device driver as recited in claim 1, further comprising a precharge unit, the precharge unit including:

a precharge current source for supplying a precharge current to the unit pixel during a precharge period; and a precharge switch for connecting the precharge current source to the unit pixel.

6. The organic light emitting device driver as recited in claim 5, further comprising a driving unit, the driving unit including:

a driving current source for supplying a driving current to the unit pixel during a driving period; and a driving switch for connecting the driving current source to the unit pixel.

7. The organic light emitting device driver as recited in claim 1, wherein a channel ratio between the first MOS transistor and the second MOS transistor is 1:m.

* * * * *